US008550052B2

(12) United States Patent
Keller et al.

(10) Patent No.: US 8,550,052 B2
(45) Date of Patent: Oct. 8, 2013

(54) PISTON FOR AN INTERNAL COMBUSTION ENGINE

(75) Inventors: Klaus Keller, Lorch (DE); Michael Ullrich, Moeglingen (DE); Rainer Scharp, Vaihingen (DE)

(73) Assignee: MAHLE International GmbH, Stuttgart (DE)

( * ) Notice: Subject to any disclaimer, the term of this patent is extended or adjusted under 35 U.S.C. 154(b) by 134 days.

(21) Appl. No.: 13/205,988

(22) Filed: Aug. 9, 2011

(65) Prior Publication Data

US 2012/0037114 A1 Feb. 16, 2012

(30) Foreign Application Priority Data

Aug. 10, 2010 (DE) ..... 10 2010 033 882

(51) Int. Cl.
*F02F 3/16* (2006.01)

(52) U.S. Cl.
USPC ..... 123/193.6; 123/41.35

(58) Field of Classification Search
USPC ..... 123/193.6, 41.35; 92/186, 208; 29/888.042
See application file for complete search history.

(56) References Cited

U.S. PATENT DOCUMENTS

| | | | | |
|---|---|---|---|---|
| 6,279,455 | B1 * | 8/2001 | Kruse | 92/186 |
| 7,762,178 | B2 * | 7/2010 | Scharp | 92/186 |
| 8,267,005 | B2 * | 9/2012 | Scharp et al. | 92/186 |
| 8,327,537 | B2 * | 12/2012 | Ribeiro | 29/888.042 |
| 2001/0025568 | A1 | 10/2001 | Kemnitz et al. | |
| 2008/0307958 | A1 * | 12/2008 | Scharp | 92/208 |
| 2010/0101527 | A1 | 4/2010 | Gniesmer | |
| 2010/0107998 | A1 * | 5/2010 | Scharp et al. | 123/41.35 |
| 2010/0108000 | A1 * | 5/2010 | Scharp et al. | 123/41.35 |
| 2010/0108001 | A1 * | 5/2010 | Scharp et al. | 123/41.35 |
| 2010/0108015 | A1 * | 5/2010 | Scharp | 123/193.6 |
| 2010/0299922 | A1 | 12/2010 | Gniesmer et al. | |
| 2011/0030645 | A1 * | 2/2011 | Rebello et al. | 123/193.6 |
| 2011/0119914 | A1 | 5/2011 | Janssen et al. | |

FOREIGN PATENT DOCUMENTS

| | | |
|---|---|---|
| DE | 10 2006 002 949 | 8/2007 |
| DE | 10 2007 018 932 | 10/2008 |
| DE | 10 2008 011 922 | 9/2009 |
| DE | 10 2008 055 908 | 5/2010 |
| EP | 1 876 344 | 1/2008 |
| WO | WO 02/33291 | 4/2002 |
| WO | WO 2010/075959 | 7/2010 |

OTHER PUBLICATIONS

German Search Report dated Jan. 10, 2011 in German Application No. 10 2010 033 882.6 with English translation of the relevant parts.

* cited by examiner

*Primary Examiner* — M. McMahon
(74) *Attorney, Agent, or Firm* — Collard & Roe, P.C.

(57) ABSTRACT

A piston for an internal combustion engine has an upper part and a lower part. The upper part has a collar with a ring rib and the lower part has a wall and a contact part radially within the wall. When the upper part is connected with the lower part by friction welding, the face surfaces of the ring rib, the collar, the wall, and the contact part form friction-welding surfaces and form a cooling channel and a cooling cavity between them. To supply the cooling channel and the cooling cavity with cooling oil, radial bores are introduced into the ring rib, which bores connect the cooling channel with the cooling cavity. In this way, it is guaranteed that a sufficient residual amount of oil collects in the cooling channel and in the cooling cavity, which amount is constantly renewed, and leads to good cooling of the piston crown.

2 Claims, 1 Drawing Sheet

PISTON FOR AN INTERNAL COMBUSTION ENGINE

CROSS REFERENCE TO RELATED APPLICATIONS

Applicants claim priority under 35 U.S.C. §119 of German Application No. 10 2010 033 882.6 filed Aug. 10, 2010, the disclosure of which is incorporated by reference.

BACKGROUND OF THE INVENTION

1. Field of the Invention

The invention relates to a piston for an internal combustion engine, having an upper part, the upper side of which forms the piston crown, and a lower part. The upper part has a circumferential collar formed onto the piston crown radially on the outside, facing downward in a direction facing away from the piston crown. A compression ring groove is disposed on a radial outside of the collar, having a circumferential ring rib disposed on the underside of the upper part, radially within the collar. The axial length of the collar is less than the distance from the lower face surface of the ring rib to the piston crown. The lower part has a circumferential wall radially on the outside, facing upward, in the radial outside of which wall ring grooves are formed. The upper face surface of the lower part has the same radial distance from the piston axis as the lower face surface of the collar. There is a circumferential contact part formed onto the lower part, facing upward and disposed radially within the wall. The upper face surface of the circumferential contact part has the same distance from the piston axis as the lower face surface of the ring rib. The upper face surface of the circumferential contact part has an axial distance from the plane defined by the face surface of the wall, which distance corresponds to the difference between the distance from the lower face surface of the ring rib to the piston crown and the length of the collar, so that when the upper part is connected with the lower part by the friction-welding, the face surfaces of the ring rib, the collar, the wall, and the contact part form friction-welding surfaces. A closed ring-shaped cooling channel delimited radially on the outside by the collar and by the wall and radially on the inside by the ring rib and by the contact part is obtained in this manner. The region between the contact part is formed by a crosspiece having an opening that lies in the center, which crosspiece forms the lower delimitation of a central cooling cavity. The cooling cavity is delimited at the top by the piston crown and radially on the outside by the contact part and by the ring rib. Two skirt elements that lie opposite one another are disposed on the underside of the lower part, which elements are connected with, one another by means of two pin bosses that lie opposite one another, each having a pin bore.

2. The Prior Art

A piston of the type stated initially is described in International Application Publication No. WO 02/33291. This piston has an oil channel disposed close to the bottom of the cooling cavity and of the cooling channel, which oil channel connects the cooling cavity with the cooling channel. This prevents the formation of an oil accumulation, particularly in the cooling cavity, and thus worsens the cooling of the piston crown, which is subject to great thermal stress, because the oil situated in the cooling cavity can flow back into the cooling channel by way of the oil channel, and oil flows from the cooling channel into the cooling cavity only if the oil level of the oil situated in the cooling channel is higher than the level of the oil situated in the cooling cavity. In this way, the through-flow of oil from the cooling channel by way of the cooling cavity to the oil drain opening is furthermore hindered, reducing the continued flow of cooling oil, and thus leading to further deterioration of the cooling of the piston crown.

SUMMARY OF THE INVENTION

It is therefore an object of the present invention to avoid this disadvantage of the state of the art and to improve the cooling of the piston crown, which is subject to great thermal stress.

This object is accomplished in that radial bores that are uniformly distributed over the circumference are introduced into the ring rib, which bores connect the cooling channel with the cooling cavity, and are spaced apart from the lower face surface of the ring rib to such an extent that sufficient space for a weld bead that is formed during friction welding remains between the bores and the face surface of the ring rib. The bores are axially spaced apart from a plane defined by the lower face surface of the collar. The crosspiece has a shape that narrows conically upward, and at least one oil inflow opening is disposed between the cooling channel and the piston interior.

In this connection, the position of the bores, spaced apart from the bottom of the cooling cavity, between the cooling channel and the cooling cavity, and the shape of the crosspiece that forms the lower delimitation of the cooling cavity, which crosspiece narrows conically upward, allows the formation of an oil accumulation in the radially outer region of the cooling cavity. This leads to good cooling of the piston crown, which is subject to great thermal stress, during the rapid back and forth movements of the piston during engine operation, in that the oil of the oil accumulation is accelerated toward the underside of the piston crown at regular intervals (Shaker effect). Furthermore, when the level of the oil situated in the cooling channel reaches the bores between cooling channel and cooling cavity, oil is passed from the cooling channel into the cooling cavity, by way of the bores, thereby improving the oil through-flow and thus the cooling of the piston crown, which is subject to great thermal stress.

It is advantageous, in this connection, if the opening of the crosspiece is closed off by a disk that is domed upward and has a centrally located opening. This disk is connected with the crosspiece by way of a snap-in connection, thereby facilitating assembly of the piston.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
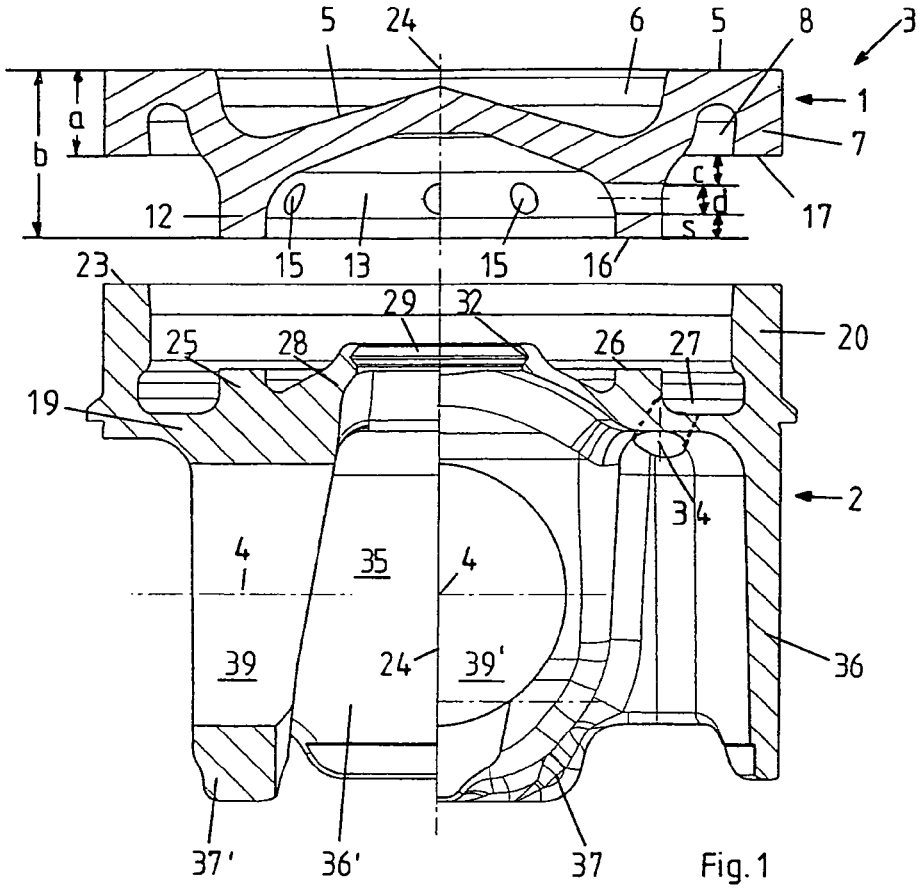
FIG. 1 shows a sectional view of the upper part and the lower part of a two-part piston for an internal combustion engine, before assembly.
Figure 2:
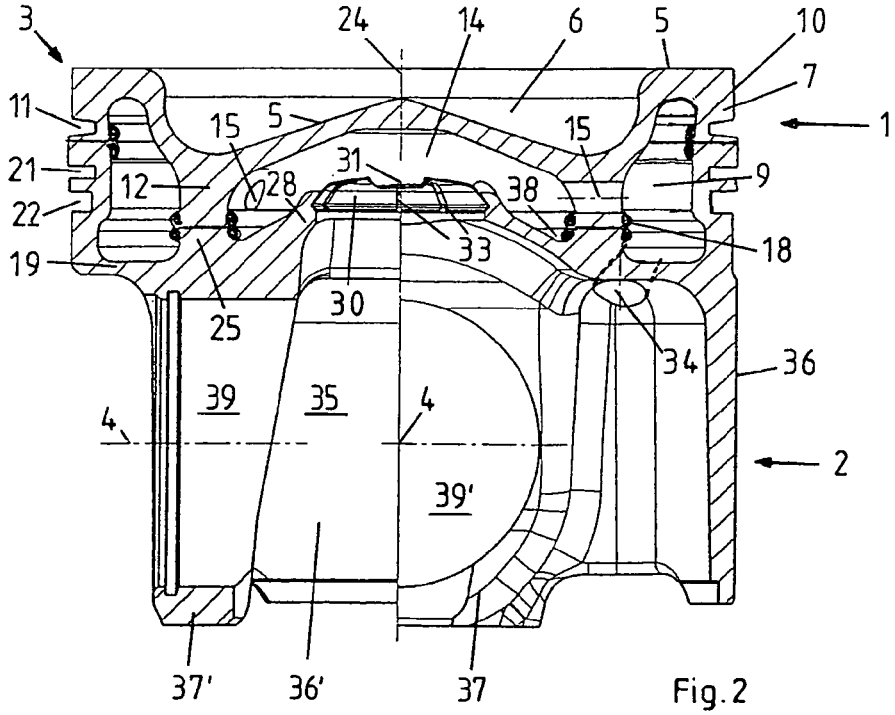
FIG. 2 shows a sectional representation of the piston, consisting of two halves, where the left half shows a section along the pin bore axis, and the right half shows a section perpendicular to the pin bore axis.

Referring now in detail to the drawings, FIGS. 1 and 2 show a piston 3 for an internal combustion engine, consisting of an upper part 1 and a lower part 2, whereby the sectional representations each consist of two halves. The left halves of the sectional representations lie on the pin bore axis 4, whereas the right halves of the sectional representations stand perpendicular on the pin bore axis 4.

The upper part 1, which consists of steel, has a piston crown on its top, with a combustion chamber bowl 6. Radially on the outside, a circumferential collar 7, facing downward, is formed onto the piston crown 5, which collar delimits a circumferential recess 8 radially on the outside. Recess 8 forms the upper part of a cooling channel 9, radially on the outside and running circumferentially in the vicinity of the piston crown, in the case of the finished piston 3 according to FIG. 2. On its radial outside, collar 7 offers room for a top land 10 and a compression ring groove 11.

Furthermore, upper part 1 has a circumferential ring rib 12 on its underside, facing away from the piston crown 5, which rib forms the radially inner delimitation of the upper part of the cooling channel 9 and the radially outer delimitation of the upper part 13 of a centrally located cooling cavity 14. Bores 15 that lie radially and are uniformly distributed over the circumference are introduced into the ring rib 12, which bores connect the cooling channel 9 with the cooling cavity 14 in the finished, assembled piston 3 according to FIG. 2. In the present exemplary embodiment, the piston 3 has four bores 15. These bores 15 can have the shape of a contoured bore that widens inward and outward.

In order to allow the bores 15 to be introduced into the ring rib 12 without problems before assembly of the piston 3, radially from the outside, the axial length "a" of the collar 7 is smaller, by a dimension, than the distance "b" of the lower face surface 16 of the ring rib 12 from the piston crown 5, which dimension is composed of the diameter "d" of the bores 15, a distance "s" of the bores 15 from the lower face surface 16 of the ring rib 12, and an axial distance "c" of the bores 15 from the lower face surface 17 of the collar 7. In this connection, the distance "c" is intended to guarantee that the drilling machine has sufficient space with regard to the collar 7 when the bores 15 are introduced. The distance "s" of the bores 15 from the lower face surface 16 of the ring rib 12 corresponds to the axial dimension of the weld bead 18 that forms when the upper part 1 and the lower part 2 are connected with one another by friction welding. This distance "s" is supposed to prevent the weld bead 18 from getting into the region of the bores 15 when the upper part 1 is welded to the lower part 2, which would prevent through-flow of the cooling oil through the bores 15.

The lower part 2 of the piston 3, which also consists of steel, consists of a bottom element 19, on the top of which, facing the piston crown, a circumferential wall 20 is disposed radially on the outside, into which wall the radially outer ring grooves 21, 22 are formed. The upper face surface 23 of the wall 20 has the same distance from the piston axis 24 as the lower face surface 17 of the collar 7, so that the face surfaces 17 and 23 form friction-welding surfaces when the upper part 1 is welded to the lower part 2.

Radially on the inside, the wall 20 is followed by a circumferential contact part 25, which has the same distance from the piston axis 24 as the ring rib 12. The upper face surface 26 of contact part 25 has an axial distance from the plane formed by the face surface 23 of the wall 20 that corresponds to the dimension (c+d+s) by which the distance "a" of the face surface 17 of the collar 7 from the piston crown 5 is less than the distance "b" of the face surface 16 of the ring rib 12 from the piston crown 5. From this, the result is achieved that when the upper part 1 is welded to the lower part 2, not only the face surfaces 17 and 23 but also the face surfaces 16 and 26 form friction-welding surfaces.

A circumferential recess 27 is formed into the bottom element 19, between the contact part 25 and the wall 20, which recess forms the lower part of the cooling channel 9 in the finished, assembled piston 3 according to FIG. 2. Radially within the contact part 25, the bottom element 19 is configured as a circumferential crosspiece 28 that narrows conically upward, which crosspiece has a centrally located, circular opening 29. The region 38 between the crosspiece 28 and the contact part 25 is configured as a circumferential channel that is open toward the top. Thus, the cooling cavity 14 is delimited at the top by the piston crown 5, radially on the outside by the ring rib 12 and by the contact part 25, and at the bottom by the crosspiece 28.

Radially on the inside, the edge 32 of the opening 29 of the crosspiece 28 (FIG. 1) has the shape, in section, of a "V" that is open radially inward. This makes it possible to attach a shell-shaped disk 30, domed upward, having a centrally located opening 31 having an outside dimension that corresponds to the inside dimension of the opening 29, and having a radially outer edge that is configured to be complementary to the edge 32 of the opening 29, in the opening 29 by means of a snap-in connection. In order for the edge of the disk 30 to demonstrate the resilience required for this, radial slits 33 are worked into the edge, between which slits the edge of the disk 30 is configured in the form of elastically resilient sheet-metal tabs. This makes it possible to press the disk 30 into the opening 29 of the crosspiece 28 from below after the piston 3 has been finished, and to fix it in place by way of the snap-in connection that results.

The cooling channel 9 is connected with the piston interior 35 by way of an oil inflow opening 34. Furthermore, two skirt elements 36, 36' that lie opposite one another are disposed on the underside of the bottom element 19, which skirt elements are connected with one another by way of two pin bosses 37, 37' that lie opposite one another, each having a pin bore 39, 39'.

During engine operation, cooling oil is introduced into the cooling channel 9 by way of the oil inflow opening 34, and this oil is accelerated against the underside of the radially outer region of the piston crown 5 and against the part of the piston 3 formed by the wall 20 and by the collar 7, as a result of the rapid back and forth movements of the piston 3, and thereby has a cooling effect here (Shaker effect). In this connection, a part of the oil gets into the cooling cavity 14 by way of the bores 15, whereby an oil accumulation forms in the radially outer region 38 of the cooling cavity 14. This accumulation remains in the cooling cavity 14 because of the position of the bore 15, spaced apart from the bottom element 19, is accelerated against the underside of the piston crown 5 in the region of the combustion chamber bowl 6, which is subject to great thermal stress, and has a cooling effect here. A part of this oil subsequently gets into the piston interior 35 by way of the opening 31 of the disk 30.

In this way, an acceleration of the oil flow through the cooling channel 9 and through the cooling cavity 14 is achieved as an advantage of the position of the bores 15, spaced apart from the bottom element 19, and the dome-like shape of the crosspiece 28 and of the disk 30, making it possible for an oil accumulation to form in the radially outer region 38 of the cooling cavity 14, and thus leads to an improvement in the cooling of the piston 3, because when the level of the oil situated in the cooling channel 9 reaches the bores 15, the oil flows exclusively from the cooling channel 9 into the cooling cavity 14 and from here into the piston interior 35, by way of the opening 31 of the disk 30.

Accordingly, while only a few embodiments of the present invention have been shown and described, it is obvious that many changes and modifications may be made thereunto without departing from the spirit and scope of the invention.

REFERENCE SYMBOL LIST a, b, c, d, s distances
1 upper part of the piston 3
2 lower part of the piston 3
3 piston
4 pin bore axis
5 piston crown
6 combustion chamber bowl
7 collar
8 recess
9 cooling channel
10 top land
11 compression ring groove
12 ring rib
13 upper part of the cooling cavity 14
14 cooling cavity
15 bore
16 lower face surface of the ring rib 12
17 lower face surface of the collar 7
18 weld bead
19 bottom element
20 wall
21, 22 ring groove
23 face surface of the wall 20
24 piston axis
25 contact part
26 upper face surface of the contact part 25
27 recess
28 crosspiece
29 opening of the crosspiece 28
30 disk
31 opening of the disk 30
32 edge of the opening 29
33 slit
34 oil inflow opening
35 piston interior
36, 36' skirt element
37, 37' pin boss
38 outer region of the cooling cavity 14, channel
39, 39' pin bore

What is claimed is:

1. A piston for an internal combustion engine, comprising:

an upper part forming a piston crown on an upper side thereof;

a circumferential collar formed onto the piston crown radially on an outside, facing downward in a direction facing away from the piston crown, wherein a compression ring groove is disposed on a radial outside of said collar;

a circumferential ring rib disposed on an underside of the upper part, radially to an inside of said collar, wherein an axial length (a) of the collar is less than a distance (b) from a lower face surface of the ring rib to the piston crown;

a lower part that has a circumferential wall radially on an outside, facing upward, wherein ring grooves are formed in a radial outside said circumferential wall, and wherein an upper face surface of said lower part has a same radial distance from a piston axis as a lower face surface of the collar;

a circumferential contact part formed onto the lower part, facing upward and disposed radially to an inside of the circumferential wall, wherein an upper face surface of said circumferential contact part has a same distance from the piston axis as the lower face surface of the ring rib, and wherein the upper face surface of the circumferential contact part has an axial distance from a plane defined by the face surface of the circumferential wall, said axial distance corresponding to a difference between the distance (b) of the lower face surface of the ring rib from the piston crown and the length (a) of the collar, so that when the upper part is connected with the lower part by friction-welding, the face surfaces of the ring rib, the collar, the wall, and the contact part form friction-welding surfaces, and form a closed, ring-shaped cooling channel delimited radially on an outside by the collar and by the wall and radially on an inside by the ring rib and by the contact part;

a crosspiece disposed adjacent the contact part on the inside, the crosspiece having a shape that narrows conically upward and an opening that lies in a center, said crosspiece forming a lower delimitation of a central cooling cavity that is delimited at a top by the piston crown and radially on an outside by the contact part and by the ring rib, and two skirt elements that lie opposite one another and disposed on an underside of the lower part, said skirt elements being connected with one another by two pin bosses that lie opposite one another, each having a pin bore, wherein bores that lie radially and are distributed over the circumference are introduced into the ring rib, said bores connecting the cooling channel with the cooling cavity, and being spaced apart from the lower face surface of the ring rib to such an extent that sufficient space for a weld bead that is formed during friction welding remains between the bores and the face surface of the ring rib, wherein the bores are axially spaced apart from a plane defined by the lower face surface of the collar so that the bores can be introduced into the ring rib radially from the outside before assembly of the piston, and wherein at least one oil inflow opening is disposed between the cooling channel and the piston interior.

2. The piston according to claim 1, wherein the opening of the crosspiece is closed off by a disk that is domed upward and has a centrally located opening, said disk being connected with the crosspiece by way of a snap-in connection.

* * * * *